US006676384B2

(12) United States Patent
Eberl

(10) Patent No.: US 6,676,384 B2
(45) Date of Patent: Jan. 13, 2004

(54) GAS FRICTION PUMP

(75) Inventor: Wolfgang Eberl, Solms (DE)

(73) Assignee: Pfeiffer Vacuum GmbH, Asslar (DE)

( * ) Notice: Subject to any disclaimer, the term of this patent is extended or adjusted under 35 U.S.C. 154(b) by 5 days.

(21) Appl. No.: 10/093,204

(22) Filed: Mar. 7, 2002

(65) Prior Publication Data

US 2002/0136643 A1 Sep. 26, 2002

(30) Foreign Application Priority Data

Mar. 24, 2001 (DE) ..... 101 14 585

(51) Int. Cl.[7] ..... F04B 3/00
(52) U.S. Cl. ..... 417/248; 417/199.1; 415/90
(58) Field of Search ..... 417/248, 307, 417/199.1, 201, 203, 423.4; 415/90, 143, 144, 145

(56) References Cited

U.S. PATENT DOCUMENTS 5,893,702 A * 4/1999 Conrad et al. ..... 415/71
6,220,824 B1 * 4/2001 Hablanian ..... 417/245
6,409,477 B1 * 6/2002 Blecker et al. ..... 417/199.1
6,464,451 B1 * 10/2002 Conrad et al. ..... 415/55.7

FOREIGN PATENT DOCUMENTS

EP 1 067 290 A2 * 1/2001 ..... 417/199.1

* cited by examiner

*Primary Examiner*—Justine R. Yu
*Assistant Examiner*—Michael K. Gray
(74) *Attorney, Agent, or Firm*—Sidley Austin Brown & Wood, LLP

(57) ABSTRACT

A vacuum pump including two gas friction pumps arranged parallel to each other and having each at least one stage having an inlet communicating with a common suction region and an outlet communicating with a separate discharge region, a multi-stage pump arranged downstream of the two gas friction pumps, connection conduits for communicating the separate discharge regions with a common discharge chamber, and a conduit for communicating the common discharge chamber with the suction chamber of the downstream pump.

9 Claims, 1 Drawing Sheet

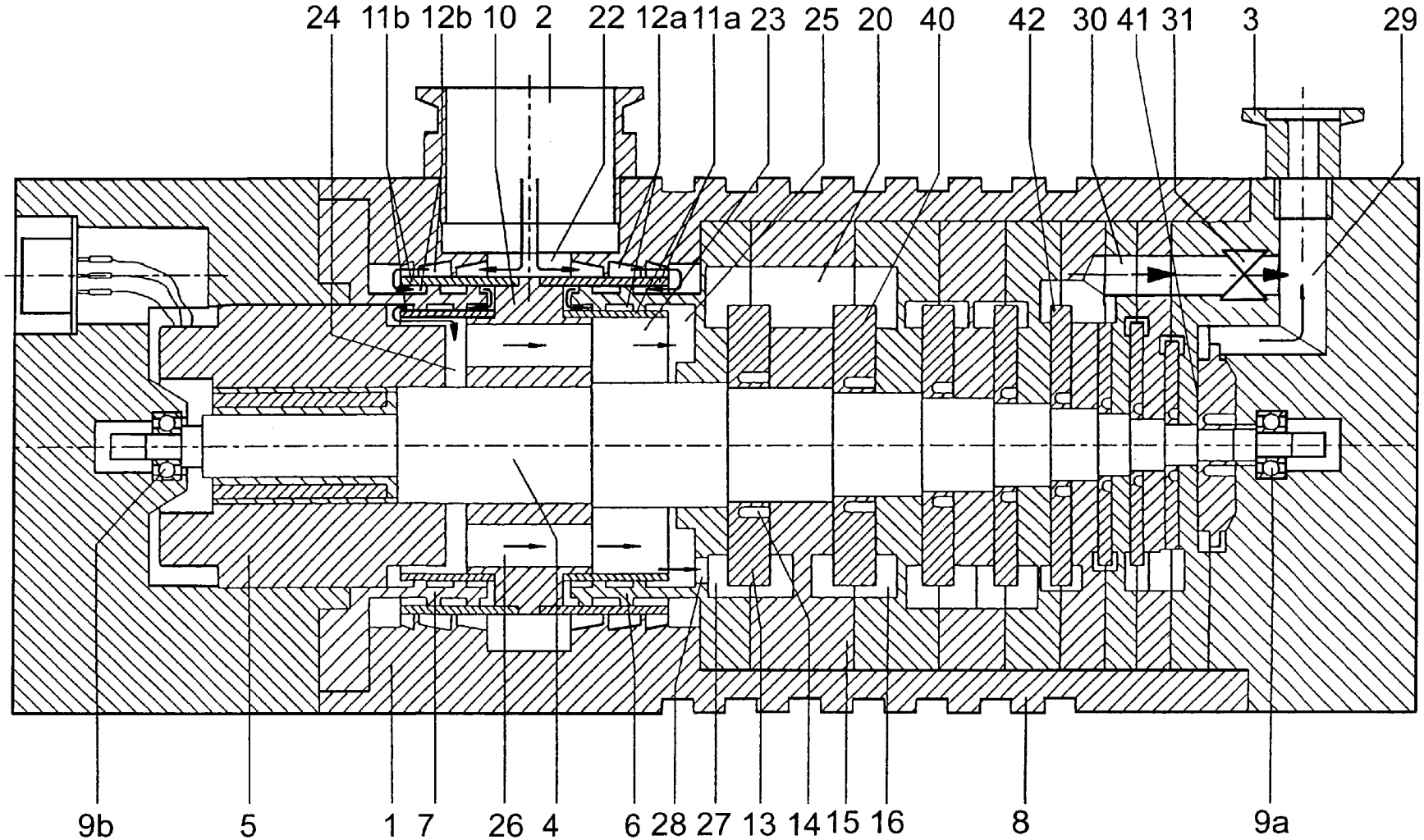
29
3
31
41
30
42
40
20
25
23
11a
12a
22
2
10
12b
11b
24
9a
8
16
15
14
13
27
28
6
4
26
7
1
5
9b

GAS FRICTION PUMP

BACKGROUND OF THE INVENTION

1. Field of the Invention

The present invention relates to a vacuum pump including two one-or multi-stage gas friction pumps and a multi-stage pump arranged downstream of the gas friction pumps.

2. Description of the Prior Art

For producing high vacuum, combinations of different types of vacuum pumps are necessary because a wide pressure region between atmospheric pressure and pressure of about $10^{-4}$ mbar and lower includes several flow regions in which the physical characteristics and conditions of gas flows are governed by different laws.

For producing a high vacuum, at least two vacuum pumps having different designs and operational characteristics are combined on a common stand. Known are stands which include a turbomolecular pump, which is used as a high vacuum pump, and a vane-type rotary pump which discharges against atmospheric pressure. Pump stands, which consist of at least two vacuum pumps, necessary for achieving the required vacuum-technical parameters, such as pressure ratio and suction capacity, are expensive and occupy a large space. Each pump requires its own drive, power supply, control means, and bearing system. Connection conduits, which connect the pumps and are provided with necessary valves, increase the costs of such pump stands.

Accordingly, an object of the present invention, is to provide a vacuum pump having a compact structure so that the above-discussed drawbacks of pump stands formed of several pumps, are eliminated.

Another object of the present invention is to provide an integral vacuum pump encompassing the entire pressure region between atmospheric pressure and pressure of about $10^{-4}$ mbar and lower.

A further object of the present invention is to provide a vacuum pump having sufficiently high pressure ratio and a suction capacity capable to meet the requirements of practical applications of a vacuum pump.

Yet another object of the present invention is to provide a vacuum pump having reliable operational characteristics.

Yet an additional object of the present invention is to provide a vacuum pump the high-vacuum side of which is lubrication-free.

SUMMARY OF THE INVENTION

These and other objects of the present invention, which will become apparent hereinafter, are achieved by providing a vacuum pump including a common suction region, two gas friction pumps arranged parallel to each other and having each at least one stage having its inlet communicating with the common suction region and its outlet communicating with a separate discharge region, a multi-stage pump arranged downstream of the two gas friction pumps and having a suction chamber, connection conduits for communicating the separate discharge region with a common discharge chamber, and a conduit for communicating the common discharge chamber with the suction chamber of the multi-stage pump. With such an arrangement, an aspirated gas stream is separated into two streams flowing each through an associated gas friction pump into a respective discharge region, with the streams from both discharge regions being combined in a common stream flowing into a common discharge chamber from which a combined stream flows into the suction chamber of the multi-stage pump, with the gas being further compressed in the multi-stage pump.

A vacuum pump according to the present invention has a compact construction and covers the entire pressure region from atmospheric pressure up to the high vacuum region. The parallel arrangement of the gas friction pumps on the high-vacuum side provides a double-flow region that insures a high suction capacity. In the gas friction pumps, the aspirated gas is sufficiently compressed, so that in the downstream pump only a single-flow gas stream is necessary. This combination, together with combining output flows of both gas friction pumps in a single flow delivered into the suction chamber of the following stage, provides for a compact structure, with a noticeable decrease in overall dimensions and with reduction in construction costs. The foregoing arrangement of pumps permits to arrange the bearing on opposite sides of the rotor shaft, which insures a stable support and permits to use bearing having a smaller diameter. A stable support insures a problem-free drive with a high rotational speed. In addition, the gas friction pumps separate the bearings from the high-vacuum side, which prevents the lubrication medium from reaching the high vacuum side.

This arrangement and the operating method favors formation of the gas friction pumps as Holweck pumps. Forming the gas friction pumps as Holweck pumps permits to obtain a maximal pressure ratio in a narrow space. The double-flow arrangement permits to obtain a necessary suction capacity.

As a multi-stage, downstream pump advantageously a regenerative pump is used. The regeneration pump compresses the gas, which is discharged by two gas friction pumps, to atmospheric pressure. With a high gas yield, any intermediate stage of the regenerative pump, except the stage adjacent to the atmospheric pressure, can be directly connected with the gas outlet flange by a connecting conduit. In this case, large amounts of gas need not be pumped through the geometrically small end stages leading to increase of time in which the gas is delivered to the gas outlet flange. When the amount of gas is small, the conduit is closed by a pressure relief valve, and compression to atmospheric pressure is effected in last stages. However, the present invention is not limited to use of a regenerative pump. Other pumps, which discharge against atmosphere can be used.

A big advantage of the regenerative pump consists in that its stator elements are formed, according to the present invention, as undivisible discs. In conventional constructions, in which divided discs are mounted between the rotor discs, a back flow through the formed gaps can take place, which leads to losses and the reduction of the pressure ratio. Using undivisible discs eliminates back flow. The uses of undivisible stator elements, however, is only possible when the rotor elements are secured on the rotor shaft, according to the present invention, with clamping rings. Only in this case, the rotor and stator elements can be alternatively mounted one behind the other, with maintaining of an optimal axial gap therebetween.

The novel features of the present invention, which are considered as characteristic for the invention, are set forth in the appended claims. The invention itself, however, both as to its construction and its mode of operation, together with additional advantages and objects thereof, will be best understood from the following detailed description of the preferred embodiment, when read with reference to accompanying drawing.

BRIEF DESCRIPTION OF THE DRAWINGS

Single FIGURE of the drawings shows a cross-sectional view of a vacuum pump according to the present invention.

DETAILED DESCRIPTION OF THE PREFERRED EMBODIMENT

A vacuum pump according to the present invention, which is shown in the drawing, includes a housing 1 provided with a suction flange 2 and a gas outlet flange 3. In the housing 1, there are provided two parallel stages each formed of a Holweck-type gas friction pump 6 and 7 and a regenerative pump 8. Rotor elements 10, 11*a*, 11*b*, and 13 of both gas friction pumps and regenerative pump 8 are supported on a common shaft 4. The shaft 4 is supported in opposite bearings 9*a* and 9*b*. The first bearing 9*a* is located in the region of the atmospheric pressure, and the bearing 9*b* is located in the region of fore-vacuum pressure. A pump drive 5 is also located in the region of fore-vacuum pressure. The rotor elements of the double-flow Holweck pump are each formed of a carrier ring 10 on which cylindrical components 11*a* and 11*b* of both parallel stages are supported. Together with stator elements 12*a*, 12*b*, which are formed as spiral flutes and surround the respective rotor elements 11*a*, 11*b*, the rotor elements 11*a*, 11*b* form, respectively, two double-flow Holweck pumps.

The regenerative pump 8 includes a plurality of rotor discs 13 which are secured on the rotor shaft 4 with clamping rings 14. Between the rotor discs 14, there are arranged stator components 15 with delivery channels 16.

The gas flows in the pump, which is shown in the drawings, in the direction indicated by arrows. First, gas flows from the suction region 22 through the two pumping Holweck stages 6 and 7, each of which consists of two serially connected pump stages 11*a*/12*a* and 11*b*/12*b*, into the discharge regions 23 and 24, respectively. Connection elements 26, which are provided between the two discharge regions 23 and 24, insure the delivery of the gas flow from both regions 23 and 24 to discharge chamber 25. Through the connection elements 28, the gas flow reaches the suction chamber 27 of the regenerative pump 8. In the regenerative pump 8, the gas is compressed to atmospheric pressure in several stages of the regenerative pump 8, which are connected with each other by channels 20, and is delivered, via a discharge chamber 29, to the gas outlet flange 3. The generative pump 8 has a beginning stage 40 fluidly connected with the common discharge chamber 25 of the friction pumps 6, 7, an end stage 44 fluidly connected with the discharge chamber 29, and an intermediate stage 42 located between the beginning stage 40 and the end stage 42 and fluidly connected with the discharge chamber 29 by a connection conduit 30. A pressure relief valve 31 is provided in the connection conduit 30.

Though the present invention was shown and described with references to the preferred embodiment, such are merely illustrative of the present invention and are not to be construed as a limitation thereof, and various modifications to the present invention will be apparent to those skilled in the art. It is, therefore, not intended that the present invention be limited to the disclosed embodiment of details thereof, and the present invention includes all of variations and/or alternative embodiments within the spirit and scope of the present invention as defined by the appended claims.

What is claimed is:

1. A vacuum pump, comprising a common suction region; two gas friction pumps arranged parallel to each other and each having at least one stage having inlet means thereof communicating with the common suction region and outlet means thereof communicating with a separate discharge region; a multi-stage pump arranged downstream of the two gas friction pumps and having a suction chamber; connection means for communicating the separate discharge regions with a common discharge chamber, and conduit means for communicating the common discharge chamber with the suction chamber of the multi-stage pump, whereby an aspirated gas stream is separated into first and second streams with the first stream flowing through one of the two gas friction pumps and the second stream flowing through the other of the two gas friction pumps into respective discharge regions, with the streams from both discharge regions being combined in a common stream flowing into a the common discharge chamber from which a combined stream flows into the suction chamber of the multi-stage pump, with the gas being further compressed in the multi-stage pump, wherein the vacuum pump further comprises a gas outlet flange, conduit means for connecting one of intermediate stages of the multi-stage pump with the gas outlet flange, and a pressure relief value arranged in the conduit means that connects the one of intermediate stages with the gas outlet flange.

2. A vacuum pump as set forth in claim 1, wherein the multi-stage pump has a discharge chamber, and means for communicating the suction chamber with the discharge chamber.

3. A vacuum pump as set forth in claim 1, wherein both gas friction pumps are formed as Holweck pumps.

4. A vacuum pump as set forth in claim 1, wherein the communicating conduit means comprises a plurality of axial bores formed in the gas friction pumps.

5. A vacuum pump as set forth in claim 1, wherein multi-stage pump is formed as a regenerative pump.

6. A vacuum pump as set forth in claim 5, wherein stator elements of the regenerative pump are formed of indivisible discs.

7. A vacuum pump as set forth in claim 6, further comprising a rotor shaft, and wherein rotor elements of the multi-stage pump are secured on the rotor shaft with clamping rings.

8. A vacuum pump, comprising:

a multi-stage regenerative pump for compressing as to atmospheric pressure, the regenerative pump having a beginning stage connected to the vacuum source, an end stage directly connected to an atmospheric pressure outlet, and an intermediate stage located between the beginning stage and the end stage;

a conduit directly connected to the intermediate stage and directly connected to the atmospheric pressure outlet; and a pressure relief valve located in the conduit.

9. A vacuum pump according to claim 8, wherein the atmospheric pressure outlet comprises an outlet flange.

* * * * *